US005161587A

United States Patent [19]

Wu

[11] Patent Number: 5,161,587

[45] Date of Patent: Nov. 10, 1992

[54] PENCIL SHARPENER WITH ACOUSTICAL AND LAMPLIGHT INDICATING EFFECT

[76] Inventor: M. H. Wu, No. 5, Lane 83, Hua Chen Rd., Hsin Chuang City, Taipei, Taiwan

[21] Appl. No.: 688,216

[22] Filed: Apr. 22, 1991

[51] Int. Cl.[5] ..... B43L 23/02

[52] U.S. Cl. ..... 144/28.5; 30/451; 30/457

[58] Field of Search ..... 30/451, 457; 144/28.3, 144/28.4, 28.5, 28.6, 28.7

[56] References Cited

U.S. PATENT DOCUMENTS

| | | | |
|---|---|---|---|
| 3,134,365 | 5/1964 | Hori | 144/28.5 |
| 3,486,540 | 12/1969 | Hori | 144/28.5 |
| 3,556,182 | 1/1971 | Tanigami | 144/28.5 |
| 3,678,975 | 7/1972 | Imanishi et al. | 144/28.5 |
| 3,746,061 | 7/1973 | Nakazaki | 144/28.5 |
| 5,052,453 | 10/1991 | Chen | 144/28.5 |

*Primary Examiner*—Frank T. Yost
*Assistant Examiner*—Hwei-Siu Payer
*Attorney, Agent, or Firm*—Armstrong, Nikaido, Marmelstein, Kubovcik & Murray

[57] ABSTRACT

The present invention is directed to a pencil sharpener that incorporates a conductive sharpening blade element for sharpening the pencil wherein the blade element is positioned along an inner wall surface of a bore hole so as to contact an outer surface of the pencil. A conductive leaf spring opposingly positioned with the blade element contacts a nib of a pencil when the pencil is sharpened by the blade element, whereby the leaf spring forms an electrical contact with the blade element through the nib of the pencil. An integrated circuit sound device for producing an audible signal is operatively connected with the blade element and leaf spring so as to generate warning signals through an indicating lamp and a buzzer.

1 Claim, 1 Drawing Sheet

PENCIL SHARPENER WITH ACOUSTICAL AND LAMPLIGHT INDICATING EFFECT

BACKGROUND OF THE INVENTION

The general object of this invention is to provide a pencil sharpener having an acoustical and lamplight indicating effect, with its shape, device and structure coming first in invention and later combined for practical use as a new device.

This invention uses primarily pencil lead, namely the pencil nib appearing outwardly after sharpening, to contact the blade and a conductive leaf spring for the electrical connection that makes the musical IC (buzzer) and the indicating lamp which were pre-set inside the pencil sharpener produce nursery rhyme-like sound and lamplight indication, respectively. The user is warned by the lamplight indication of the status of the sharpening process. This warning avoids the breaking of pencil lead and the excessive sharpening of the pencil in which the pencil is wastefully made shorter and shorter.

SUMMARY OF THE INVENTION

The known pencil sharpeners currently in use by students largely come in automatic and manual types. We do not go into details here about the automatic pencil sharpener because of its complex structure, many more components and high price. The ordinary manual pencil sharpener often breaks the pencil lead on stronger turns in sharpening. Also, users of the manual pencil sharpener may not know when the sharpening is finished and thus unnecessarily make the pencil shorter and shorter.

Considering the above defects, the present invention is directed to a pencil sharpener device which can indicate the end of sharpening by means of an acoustical device and lamplight indication, thus avoiding the breaking of the pencil lead and making the pencil unnecessarily shorter and shorter through sharpening.

The general object of this invention is to provide a pencil sharpener having an acoustical effect and lamplight indication, for enabling school-age children to indirectly enhance their studying and knowledge pursuit.

Another object of this invention is to achieve the warning function means of an acoustical and lamplight indicating so as to avoid the occurrence of pencil lead breakage and waste in sharpening that results from not knowing that the sharpening has been finished.

The following accompanying drawing will be given to illustrate in detail the structure, device, function and characteristics.

DESCRIPTION OF THE PREFERRED EMBODIMENT

Figure 1:
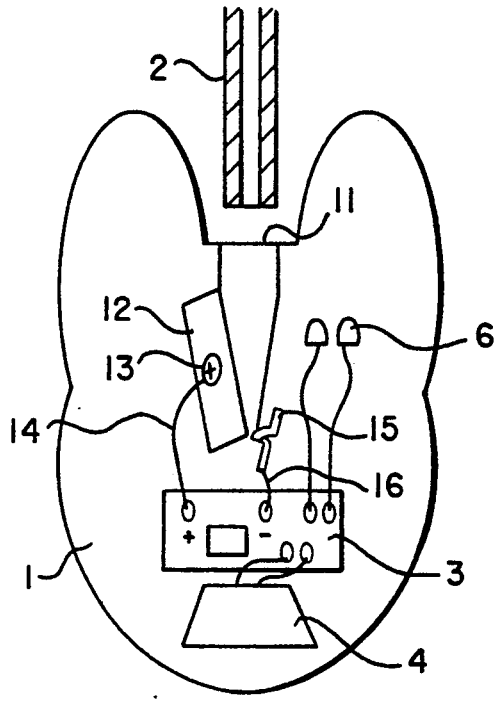
FIG. 1 is a structural figure of the invention.

This invention as described in FIG. 1 mainly includes a main body 1, which can be any form, such as a cartoon figure form or animal form, etc. The hole 11 is opened on the main body 1 which services as pre-shaped bore hole for a pencil 2 so as to provide positioning for the cutter. One blade 12 is fitted on one side of the hole 11, with the blade 12 fixed tightly by a screw 13 and connected to a power supply lines 14. An IC musical piece 3 is connected to another end of power supply lines 14, and also the IC musical piece 3 is connected in series with buzzer 4 for making sound. A conductive leaf spring 15 is set at the nib position at the other side of the hole 11, with the conductive leaf spring also connecting a power supply line 16 and the IC musical piece 3 to form a circuit for the power supply. A lamp 6 is installed in series on IC musical piece 3. The lamp 6 can be fixed in any position such as the animal eyes, nose . . . and so on, of the main body 1.

Figure 2:
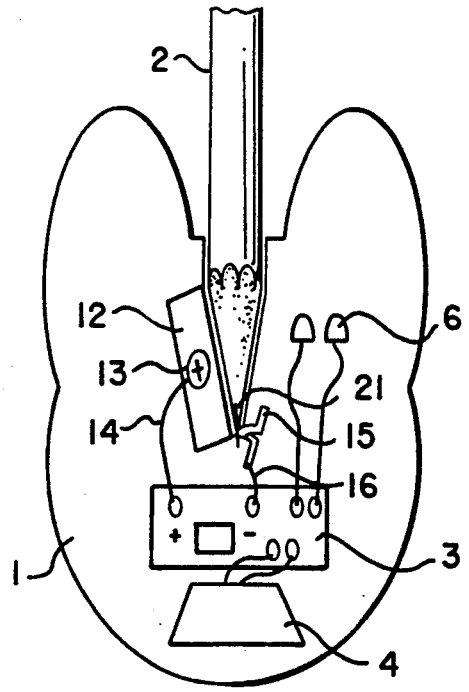
FIG. 2 is an application drawing of the present invention.

When using this invention as shown in FIG. 2, the pencil lead 21 of the pencil 2, namely the nib, will contact the blade 12 and conductive leaf spring 15 after the sharpening of the pencil 2 is completed so as to close the circuit. At that time, a nursery rhyme or other chime will sound out immediately, with the lamp also turning on. By means of this acoustical effect and lamp indication, the user can know that the sharpening of pencil has finished. This avoids possibly breaking of pencil lead and/or waste.

I claim:

1. A pencil sharpener having acoustical and lamplight-indicating effects, the pencil sharpener consisting of:

a main body having a pre-shaped bore hole through which a pencil to be sharpened is fitted;

a conductive sharpening blade means for sharpening the pencil, said blade means being positioned along an inner wall surface of the bore hole so as to contact an outer surface of the pencil;

a conductive leaf spring opposingly positioned with said blade means so as to contact a nib of the pencil when the pencil is sharpened by said blade mans, said leaf spring being further positioned so as to form an electrical contact with said blade means through the nib of the pencil;

an integrated circuit sound means for producing an audible signal, said blade means and leaf spring being operatively connected to said integrated circuit sound means;

an indicating lamp operatively connected to said integrated circuit sound means; and a buzzer for producing sound operatively connected to said integrated circuit means, said integrated circuit sound means connected so as to activate said indicating lamp and said buzzer when said leaf spring is electrically connected to said blade means through the nib of the pencil.

* * * * *